US005292025A

United States Patent [19]

Dubreul

[11] Patent Number: 5,292,025

[45] Date of Patent: Mar. 8, 1994

[54] METALLIC CONTAINER PARTLY OPENABLE BY RUPTURE OF A LINE OF REDUCED STRENGTH

[75] Inventor: Jacques F. Dubreul, Talloires, France

[73] Assignee: Sollac, Puteaux, France

[21] Appl. No.: 957,780

[22] Filed: Oct. 8, 1992

[30] Foreign Application Priority Data

Oct. 11, 1991 [FR] France ..... 91 12574

[51] Int. Cl.[5] ..... B65D 17/44

[52] U.S. Cl. ..... 220/278; 215/250; 220/268; 222/83

[58] Field of Search ..... 215/228, 235, 250; 220/277, 278, 265, 267, 268; 222/81, 83

[56] References Cited

U.S. PATENT DOCUMENTS

| | | | |
|---|---|---|---|
| 2,732,017 | 1/1956 | Fleming | 220/278 X |
| 3,187,918 | 6/1965 | Moore | 220/277 X |
| 3,924,777 | 12/1975 | Peyser | 222/81 X |
| 4,076,147 | 2/1978 | Schmit | 220/465 X |
| 4,133,319 | 1/1979 | Bloomfield | 220/713 X |
| 4,678,098 | 7/1987 | Oka | 222/81 X |
| 4,907,722 | 3/1990 | Ueda et al. | 220/278 X |

FOREIGN PATENT DOCUMENTS

| | | |
|---|---|---|
| 2259758 | 8/1975 | France . |
| 446092 | 3/1968 | Switzerland . |

*Primary Examiner*—Allan N. Shoap
*Assistant Examiner*—Christopher J. McDonald
*Attorney, Agent, or Firm*—Oblon, Spivak, McClelland, Maier & Neustadt

[57] ABSTRACT

A metallic or composite container (2) comprising a side forming a partly openable lid (4) having a fixed part in which an opening panel (16*a*) is delimited by a line of reduced strength (8), a connection zone (15) however remaining between the fixed part and the panel so that, by exerting on the panel a pressure in a direction toward the interior of the container, the line of reduced strength (8) is ruptured and the panel is swung toward the interior of the container about the connection zone (15). The fixed part of the lid is so shaped as to define a cavity extending toward the interior of the container, the cavity having a lateral wall (12) and a bottom wall in which the opening panel (16*a*) is at least partly formed.

8 Claims, 3 Drawing Sheets

METALLIC CONTAINER PARTLY OPENABLE BY RUPTURE OF A LINE OF REDUCED STRENGTH

The present invention relates to rapidly opened containers, in particular cans for a beverage.

Such cans, generally cylindrical, comprise a radially extending end side forming a lid. The lid comprises a fixed part in which an opening panel for partly opening the lid is delimited by a line of reduced strength, a connection zone remaining however between the fixed part of the lid and the opening panel.

A manual opening element is fixed to the outer side of the fixed part of the lid.

When the opening element is manually actuated, it ruptures by a leverage effect the line of reduced strength and causes the opening panel to swing about said connection zone toward the interior of the can, without any separation of the opening panel from the fixed part of the lid.

An opening is in this way created which allows the contents of the can to be poured into a glass or tumbler, or directly into the mouth of the consumer.

The direct pouring of the beverage into the mouth of the consumer is not very easy and sometimes produces cuts on the lips of the consumer.

Further, as the opening panel is exposed to the surrounding medium, it is usually covered with impurities which are present in the beverage when it is poured out of the can.

Such a can cannot be closed after pouring a part of the beverage.

An object of the invention is to overcome these drawbacks by providing a container comprising a lid which is rapidly partly opened, in particular a beverage can, which is more hygienic, facilitates the direct pouring into the mouth of a consumer, and can be reclosed.

The invention therefore provides a metallic or composite container comprising a side forming a partly openable lid having a fixed part in which an opening panel is delimited by a line of reduced strength, a connection zone remaining however between the fixed part and the panel so that, by exerting on the panel a pressure in a direction toward the interior of the container, the line of reduced strength is ruptured and the panel is swung toward the interior of the container about the connection zone, the fixed part of the lid being so shaped as to define a cavity extending toward the interior of the container, said cavity comprising a lateral wall and a bottom wall in which the opening panel is at least partly formed, characterized in that the container comprises opening means which are movable relative to the panel in such manner as to exert on the panel said pressure in a direction toward the interior of the container, said opening means comprising an element mounted on the fixed part of the lid to be rotatable about an axis which is oriented obliquely relative to the bottom wall of the cavity, an active part of the rotatable element extending inside the cavity in the vicinity of the opening panel.

According to other features of the invention:

said axis is the axis of the cavity;

the bottom wall of the cavity is a planar wall oriented obliquely relative to the axis of the cavity, the active part of the opening means being a bevel which makes with said axis an angle less than or equal to the angle that the planar wall makes with the axis and which extends to the vicinity of the part of the planar wall which is the innermost inside the can;

the panel is formed by two symmetrical planar walls oriented obliquely relative to the axis of the cavity, the active part of the opening means comprising two symmetrical bevels which make with the axis of the cavity an angle less than or equal to the angle that said two planar walls make with the axis, each bevel being located in facing relation to the respective planar wall;

the lateral wall of the cavity is connected to the adjacent zone of the fixed part of the lid by a connection zone which defines a circular bead projecting outwardly of the container, the rotatable element being mounted around the bead;

the rotatable element constitutes a removable closure member for the cavity;

the rotatable element comprises a resiliently deformable cylindrical wall provided with a projecting rib on its inner side, the rib being received by a clipping action in the zone connecting the bead to the fixed part of the lid, the cylindrical wall including at its end opposed to the rib a transverse wall from which extends a cylindrical part whose free end constitutes the active part of the opening means;

the rotatable element is composed of plastics material.

A better understanding of the invention will be had from the following description given by way of example with reference to the accompanying drawings in which.

Figure 1:
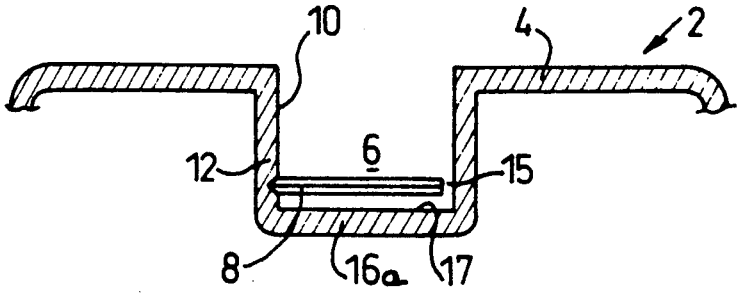
FIG. 1 is a partial sectional view of a first embodiment of a container according to the invention before it has been opened.

FIG. 1 shows a part of an easily opened metallic or composite container 2 whose lid 4 is so arranged as to define a cavity 6 extending toward the interior of the container.

An incision 8 forming a line of reduced strength is arranged on the outer side 10 of the lateral wall 12 of the cavity 6.

A connection zone 15 remains however between the lateral wall and the bottom wall **16*a*** of the cavity which constitutes an opening panel.

This configuration, in which the line of reduced strength is arranged on the outer side 10 of the wall of the cavity 6 and not on the bottom wall **16*a***, permits subjecting said line of reduced strength to compressive stresses owing to the internal pressure in the container and not to tensile stresses so that it is possible to reduce the thickness of the remaining metal and therefore reduce the force required to open the container.

Figure 2:
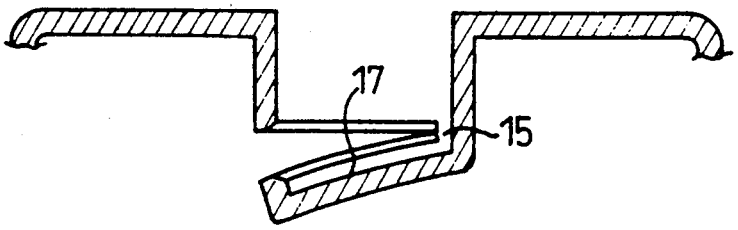
FIG. 2 is a view similar to FIG. 1 of the opened container.
Figure 3:
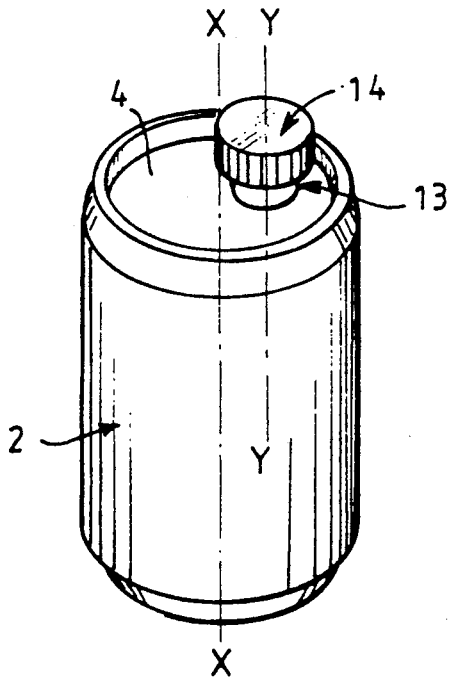
FIG. 3 is a perspective view of a second embodiment of a container according to the invention.
Figure 4:
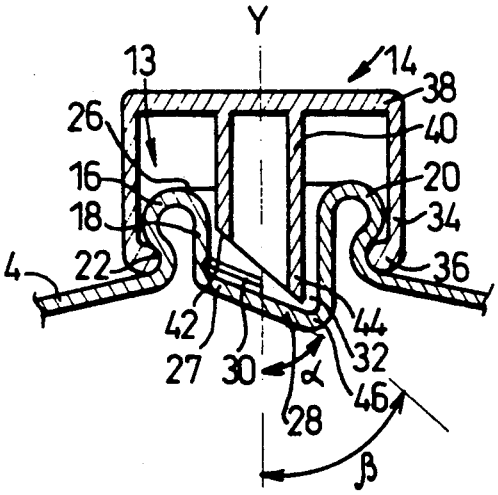
FIG. 4 is a partial sectional view of the container of FIG. 3 in the closed state.
Figure 5:
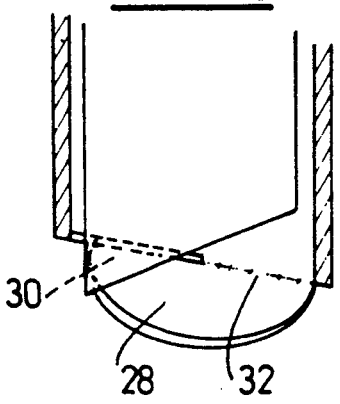
FIG. 5 is a partial sectional view of the container of FIG. 4 in the course of the partial opening of the lid.

By bearing on the outer side 17 of the opening panel the incision is ruptured and the opening panel is swung toward the interior of the container about the connection zone 15 (see FIG. 2) and thereby opens the container.

FIGS. 3 to 7 show a second embodiment of a container 2 according to the invention constituting a cylindrical can in which the cavity 6 partly projects out of the lid 4 and in this way defines a neck 13 having an axis Y—Y parallel to the axis X—X of the can 2.

In an alternative arrangement (not shown), the axis Y—Y may coincide with the axis X—X.

The neck 13 (see FIG. 4) comprises an outer wall 16 and an inner wall 18 constituting the lateral wall of the cavity 6, the walls 16 and 18 being interconnected by a brim 20.

The neck 13 defines on its outer side an annular groove 22 and a bead.

The cavity 6 has an open end 26 and an opposite end closed by a bottom wall 27 inclined at an angle $\alpha$ relative to the axis Y—Y.

An opening panel 28 is defined in the bottom wall 27 of the cavity by a line 30 of reduced strength, a connection zone 32 remaining however between the wall 18 and the panel 28.

The connection zone 32 extends for example in a sector subtending an angle of about 90°, the line of reduced strength subtending an angle of about 270°.

This angular value may be different in accordance with the relative magnitudes of the angles $\alpha$ and $\beta$, or in accordance with the desired opening, its adaptation being within the capability of one skilled in the art.

An element 14 (see also FIG. 3) adaptable on the neck 13 has a double function: to constitute on one hand a removable closure member for the cavity 6 and on the other hand an opening element by rotation of the element 14 around the neck 13.

For this purpose, the element 14 comprises a radially resiliently deformable cylindrical outer lateral wall 34 having an axis Y—Y.

The wall 34 has at a first open end an annular rib 36 adapted to be received in the groove 22 of the neck.

The second end of the wall 34 is closed by a radially extending wall 38 from which opening means extend toward the interior of the cavity 6.

The opening means are formed by a tubular part 40 coaxial with the wall 34.

The tubular part 40 has a bevelled end, i.e. a planar face 42 inclined at an angle $\beta$ relative to the axis Y—Y.

The angle is less than or equal to the angle.

The length of the tubular part 40 is such that after the wall 34 has been resiliently deformed, the rib 36 is received in the groove 22, the zone 44 of the planar face 42 which is the most remote from the radially extending wall 38 is located in the immediate vicinity of the zone 46 of the panel 28 which is the most remote from the opening 26 of the cavity 6.

Figure 6:
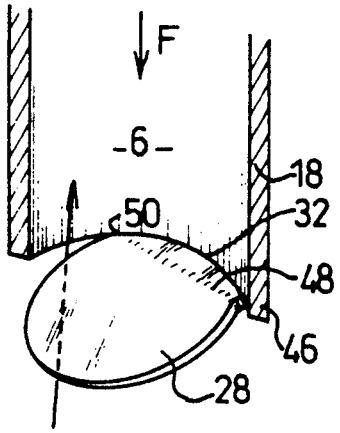
FIG. 6 is a view similar to FIG. 5 in which the container is opened, the opening means having been withdrawn from the lid.
Figure 7:
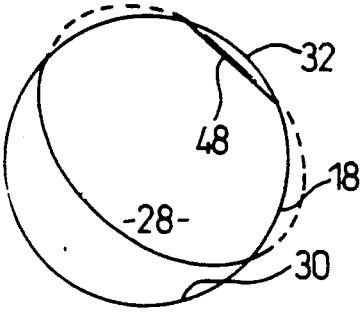
FIG. 7 is a diagrammatic view in the direction of arrow F in FIG. 6.

The zone 46 is located at one of the ends of the connection zone 32 (see also FIG. 6).

The element 10 is for example made from a plastics material.

This element 10 is removably fixed to the neck 13 and is mounted to be rotatable about the axis Y—Y, the opening means constituted by the tubular part 40 being therefore rotatable about the axis Y—Y.

The lid 4 is made by a blanking and forming press operation on a thin sheet of metal so as to define the neck 13 and is fixed to the cylindrical body of the can 2 filled with its contents.

The lid 4 can be fixed for example by a seaming operation.

When this has been done, the element 14 is removably fixed on the neck 13.

For this purpose, references (not shown) may be provided on the opening element 10 and the fixed part of the lid 4 to ensure a predetermined angular positioning of the opening element 10 about the axis Y—Y so that the zone 44 of the opening means is correctly located, as described hereinbefore, and the rib 36 can be inserted in the groove 22, which is not possible if the zone 44 is angularly incorrectly positioned.

To use the can arranged in this way, it is sufficient to turn the element 14 in such manner that the zone 44 of the opening means comes to bear against the panel 28 in the vicinity of the line of reduced strength 30.

An arrow (not shown) may indicate on the outer side of the wall 38 the direction of rotation to be applied to the opening element 10.

Indeed, when the element 14 is rotated in the direction opposed to that indicated by the arrow, the zone 44 of the opening means comes to bear against the panel in the vicinity of the connection zone 32, which urges the element 14 upwardly and causes the rib 36 to leave the groove 22.

When the element 14 is rotated in the opening direction, the zone 44 of the opening means exerts a force on the panel 18 in such manner that the line of reduced strength is progressively ruptured (see FIG. 5), the rib 36 engaged in the groove 22 and the force exerted by the user preventing an axial displacement of the opening means outwardly of the can.

The progressive rupture of the line of reduced strength 30 is accompanied by a progressive swinging toward the interior of the can of the panel 28 disconnected from the wall of the cavity 26 under the action of the planar face 42 constituting an opening means.

This swinging movement occurs about a fold line 48 (see FIGS. 6 and 7) joining the ends of the connection zone 32 when the opening has been fully achieved.

In this position, the cavity 6 is open, the fluid contained in the can being free to flow in the space defined between the panel 28 and the wall 18 (see the arrows in FIG. 6).

When the element 14 in the illustrated embodiment has rotated through about 270°, the end 44 of the tubular part 40 comes to bear at 50 against the panel 28 in the vicinity of the connection zone 32 (see also FIG. 6) which offers an increased resistance and does not rupture.

The tubular part 40 is then subjected to an axial force in a direction outwardly of the can and the opening means are subjected to a resultant axial movement in opposition to the resistance opposed by the rib 36 received in the groove 22.

The axial force exerted on the opening means is transmitted to the rib 36 and this causes the radial deformation of the wall 34 and the disengagement of the rib 36 from the groove 22 which thus detaches the element 14 from the neck 13.

With the can in this way partly opened, the fluid contained therein can be poured through the neck 13 into a tumbler, or directly into the mouth of the consumer with no risk of injuring the latter.

The presence of the element 14 constituting a closure member for the cavity 6 prevents impurities from reaching the opening panel.

After a part or all of the fluid contained in the can has been poured from the latter, the element 14 constituting a closure member can be once more removably fixed to the neck 13.

The element 14 may advantageously include a sealing element of known type (not shown), for example having a lip, or an O-ring to provide a seal between the neck 13 and the element 14.

Such an arrangement has the advantage of enabling a partly emptied can to be transported with no risk of an accidental spilling.

Figure 8:
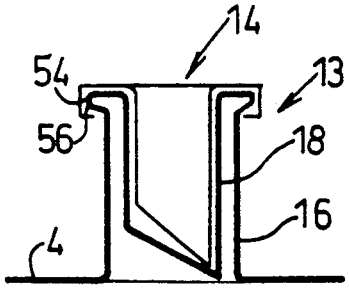
FIG. 8 is a diagrammatic view similar to FIG. 4 of an alternative embodiment of the container shown in FIGS. 3 to 7.

FIG. 8 is a diagrammatic view of an alternative embodiment in which the lateral walls 16 and 18 extend completely outside the can from the lid 4.

In this embodiment, the neck 13 has at its end remote from the lid 4 a rib 54 around which the element 14 is rotatably mounted and detachably fixed by means of a groove 56.

Figure 9:
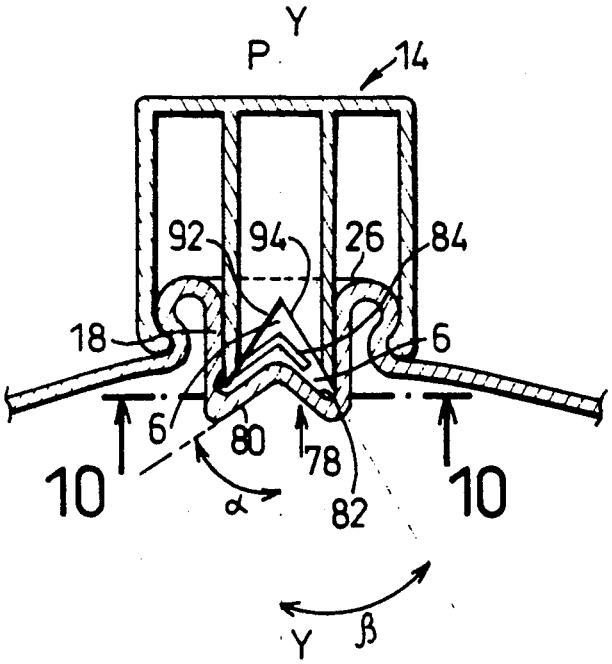
FIG. 9 is a view similar to FIG. 2 of a third embodiment of a container according to the invention.
Figure 10:
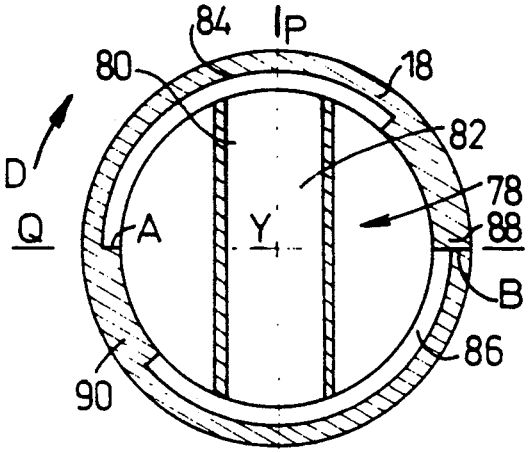
FIG. 10 is a partial sectional view taken on line 10—10 of FIG. 9.

Shown in FIGS. 9 and 10 is a third embodiment of a container according to the invention in which the container is opened by rotating the element 14 to an extent which is only half that of the element 14 in the second embodiment described hereinbefore.

Only the opening panel and the opening means have been modified to obtain this feature.

The opening panel 78 is formed by two planar semi-walls 80 and 82 which are symmetrical relative to an axial plane P of the cavity 10 (see FIG. 10). Each semi-wall 80 or 82 makes a predetermined angle $\alpha$, already defined, with said plane of symmetry.

The line of reduced strength is defined by a first curve of reduced strength 84 and a second curve of reduced strength 86 which are symmetrical relative to the axis Y—Y of the cavity 6.

The connection between the panel 78 and the cylindrical wall 18 of the cavity 6 includes a first connection zone 88 and a second connection zone 90.

In this way there are provided two arrangements similar to the second embodiment but extending angularly substantially 180° instead of 360° and symmetrical relative to the axis Y—Y.

As shown in FIG. 10, in starting at a point A of the cylindrical wall 18 contained in an axial plane Q perpendicular to the plane of symmetry P, and travelling in the direction of the arrow D, there are provided in succession the first curved line 84 of reduced strength, the first connection zone 88, the second curved line 86 of reduced strength, and the second connection zone 90.

In an alternative embodiment, one of the connection zones 88 or 90 may be provided with an incision.

Each connection zone 88 and 90 extends angularly about 45°.

The part of the semi-wall 80 the most remote from the opening 26 is located in the immediate vicinity of the point A, while the symmetrical part of the semi-wall 82 is located in the vicinity of the point B symmetrical with A relative to the plane P.

With reference now to FIG. 9, it is clear that the opening means comprise a first planar bevelled face 92 and a second planar bevelled face 94 each making with the plane P the previously-mentioned angle $\beta$ which is smaller than the angle $\alpha$.

In the storing position, the innermost part of the cavity of the first planar face 92 is located in the vicinity of the point A and the symmetrical part of the second planar face 94 is located in the vicinity of the point B (see FIG. 10).

Each curved line of reduced strength 84 or 86 extends angularly about 135°, it being understood that this value may be easily modified by one skilled in the art.

By turning the element 14 in the direction of arrow D shown in FIG. 10, the edge of the first planar face 90 breaks the first curved line of reduced strength 84 and swings downwardly toward the interior of the can first of all the part of the semi-wall 80 located in the vicinity of the first curved line 84, then the part of the semi-wall 82 located in the vicinity of said first curved line 84, and finally comes in contact with the first connection zone 88 which resists the action of the opening means, shifts the latter outwardly of the can and disengages the element 14 from the neck 13.

The second planar face 94 acts simultaneously and in the same way on the second curved line 86 and the second connection zone 90.

A can according to the invention is thus provided in which the lid is partly opened by rotating the opening element through 180°, this can having the same advantages as the can described in the second embodiment of the invention which is opened by rotating the element 14 through 360°.

What is claimed is:

1. A comprising a side constituting a partly openable lid having a fixed part, a line of reduced strength defining in said fixed part an opening panel, a connection zone remaining between said fixed part and said panel so that in exerting on said panel a pressure directed toward the interior of said container, said line of reduced strength is broken and said panel is swung toward the interior of said container about said connection zone, said fixed part of said lid being so shaped as to define a cavity extending toward the interior of said container, said cavity comprising a lateral wall and a bottom wall in which bottom wall said opening panel is formed at least partly, said container further comprising opening means which are movable relative to said panel in order to exert said pressure on said panel, said opening means comprising an element mounted to be rotatable on said fixed part of said cover about an axis oriented obliquely relative to said bottom wall of said cavity, an active part of said rotatable element extending inside said cavity in the vicinity of said opening panel.

2. Container according to claim 1, wherein said axis about which said element is rotatable is an axis of said cavity.

3. Container according to claim 1, wherein said bottom wall of said cavity is constituted by a planar wall oriented obliquely relative to said axis, said active part of said element being a bevel which makes with said axis an angle at the most equal to the angle said planar wall makes with said axis and which extends to the vicinity of a part of said planar wall which is innermost in said container.

4. Container according to claim 1, wherein said panel is constituted by two symmetrical planar walls oriented obliquely relative to said axis, said active part of said element comprising two symmetrical bevels making with said axis an angle at the most equal to the angle that said two planar walls make with said axis, each bevel being located in facing relation to a respective one of said two planar walls.

5. Container according to claim 1, comprising a connection zone connecting said lateral wall of said cavity to an adjacent zone of said fixed part of said lid, said connection zone defining a circular bead projecting outwardly of said container, said rotatable element being mounted around said bead.

6. Container according to claim 1, wherein said rotatable element constitutes a removable closure member for said cavity.

7. Container according to claim 6, wherein said rotatable element comprises a resiliently deformable cylindrical wall provided with a rib projecting from an inner side of said cylindrical wall, said rib being received by a clipping action in a zone connecting said bead to said fixed part of said lid, said cylindrical wall being combined at an end thereof opposed to said rib with a transversely extending wall from which extends a tubular part having a free end which constitutes said active part of said opening means.

8. Container according to claim 1, wherein said rotatable element is composed of plastics material.

* * * * *